US006804487B2

(12) United States Patent
Yokota

(10) Patent No.: US 6,804,487 B2
(45) Date of Patent: Oct. 12, 2004

(54) ELECTROPHOTOGRAPHIC APPARATUS

(75) Inventor: Yasuhiro Yokota, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/427,949

(22) Filed: May 2, 2003

(65) Prior Publication Data

US 2003/0228174 A1 Dec. 11, 2003

Related U.S. Application Data

(62) Division of application No. 09/984,493, filed on Oct. 30, 2001, now Pat. No. 6,615,012.

(30) Foreign Application Priority Data

Oct. 31, 2000 (JP) ..... 2000-333923

(51) Int. Cl.[7] ..... G03G 15/10

(52) U.S. Cl. ..... 399/250; 399/237

(58) Field of Search ..... 399/91, 237, 250, 399/251, 92, 93

(56) References Cited

U.S. PATENT DOCUMENTS 4,462,675 A 7/1984 Moraw et al.

FOREIGN PATENT DOCUMENTS

JP 63-143926 6/1988

*Primary Examiner*—Hoang X Ngo
(74) *Attorney, Agent, or Firm*—Oblon, Spivak, McClelland, Maier & Neustadt, P.C.

(57) ABSTRACT

The electrophotographic apparatus of an embodiment of the present invention is an elelctrophotographic apparatus having an electrostatic latent image holding device, an image forming device which forms an electrostatic latent image on the latent image holding device and developing the electrostatic latent image by a liquid developer having a carrier liquid and toner particles dispersed in the carrier liquid, a cabinet for housing the electrostatic latent image holding device and image forming device, and a carrier liquid removal device for removing a carrier liquid evaporation component vaporized and generated in the cabinet and the carrier liquid removal device has an atomizer for spraying a cyclodextrin solution into gas containing the aforementioned carrier liquid evaporation component as a removal agent for removing the carrier liquid evaporation component.

6 Claims, 3 Drawing Sheets

ELECTROPHOTOGRAPHIC APPARATUS

CROSS-REFERENCE TO RELATED APPLICATION

This application is based upon and claims the benefit of priority from the prior Japanese Patent Application No. 2000-333923, filed on Oct. 31, 2000, the entire contents of which are incorporated herein by reference.

BACKGROUND OF THE INVENTION (1) Field of the Invention

The present invention relates to an electrophotographic apparatus and more particularly to an electrophotographic apparatus using liquid developer having a carrier liquid removal device for collecting and removing a vaporized carrier liquid.

(2) Description of the Related Art

An electrophotographic apparatus using a liquid developer has advantages which cannot be realized by a dry type electrophotographic apparatus and its value has been reviewed recently. For example, a liquid developer is used to disperse toner particles in a carrier liquid, so that the points that a high image quality can be realized because extremely fine toner particles of sub-micron size can be used, and the liquid developer is economical because sufficient image density can be obtained by a small amount of toner particles and moreover, a texture similar to print (for example, offset print) can be realized, and energy conservation can be realized because toner particles can be fixed to a recording form at a comparatively low temperature are main advantages of an electrophotographic apparatus using liquid developer over the dry type.

On the other hand, some essential problems are included in the conventional electrophotographic art using a liquid developer, consequently the dry type art has been unrivaled over a long period of time.

For example, as the aforementioned carrier liquid, a highly resistant or insulating liquid must be used and a petroleum solvent must be used as a carrier liquid. This petroleum solvent is highly volatile and gives off a bad smell, so that the use in an office or a room cannot be realized.

Various methods for processing a highly volatile carrier liquid are carried out conventionally and for example, in Japanese Patent Application Laid-Open 48-82835, vapor of a carrier liquid in the cabinet is sucked in, liquified, and collected so as to suppress it from ejection outside the cabinet. However, a method for liquefying and collecting carrier liquid vapor by cooling is adopted and in this case, to cool the carrier liquid, water vapor mixed in the carrier liquid vapor must be cooled at the same time and the collection efficiency of carrier liquid vapor is bad. Further, in addition to the liquefying method, there is a method for adsorbing and collecting carrier liquid vapor by a collection agent such as activated carbon. However, the collection characteristic of activated carbon for an early very short period is good, while after a lapse of the period, the collection characteristic lowers suddenly, and stable collection of carrier liquid vapor becomes difficult, and when activated carbon is used as a collection agent, the collection amount of a carrier liquid is not found visually, so that a problem arises that it is difficult to make a schedule of exchange of the collection agent.

BRIEF SUMMARY OF THE INVENTION

As mentioned above, in a conventional elelctrophotographic apparatus using liquid developer, for example, carrier liquid vapor is collected and removed using a removal agent such as activated carbon, though a problem arises on activated carbon that the reduction in collection capacity of carrier liquid vapor is not found visually.

The present invention was developed with the foregoing problems in view and is intended to provide an elelctrophotographic apparatus using liquid developer having a carrier liquid removal device which can easily make a schedule of exchange of the removal agent.

The present invention uses a solution of cyclodextrin as a removal agent of carrier liquid vapor generated in the cabinet of the elelctrophotographic apparatus during liquid development.

The electrophotographic apparatus of the present invention is an elelctrophotographic apparatus having an electrostatic latent image holding device, an image forming device which forms an electrostatic latent image on the latent image holding device and developing the electrostatic latent image by a liquid developer having a carrier liquid and toner particles dispersed in the carrier liquid, a cabinet for housing the electrostatic latent image holding device and image forming device, and a carrier liquid removal device which removes carrier liquid vapor vaporized and generated in the cabinet and the carrier liquid removal device has an atomizer for spraying a cyclodextrin solution into gas containing the aforementioned carrier liquid vapor as a removal agent for removing the carrier liquid vapor.

The electrophotographic apparatus of the present invention is an elelctrophotographic apparatus having an image forming device which forms an electrostatic latent image on a latent image holding device and developing the electrostatic latent image by a liquid developer having a carrier liquid and toner particles dispersed in the carrier liquid, a cabinet for housing the electrostatic latent image holding device and image forming device, and a carrier liquid removal device for removing a carrier liquid evaporation component generated by evaporation of the carrier liquid from the cabinet and the carrier liquid removal device has a removal container having an inlet for introducing the mixed gas and an outlet for ejecting residual gas after the carrier liquid evaporation component is removed, an atomizer which sprays a solution containing cyclodextrin for producing a solid inclusion compound in contact with the carrier liquid in the removal container, a separator which separates the unreacted cyclodextrin solution collected in the liquid removal container from the solid component, and a circulator which circulates and resprays the solution separated by the separator in the atomizer.

The carrier liquid removal device of the electrophotographic apparatus of the present invention is a carrier liquid removal device for removing the evaporation component generated by evaporation of the carrier liquid in the cabinet for housing the image forming device for developing an electrostatic latent image by a liquid developer having a carrier liquid and toner particles dispersed in the carrier liquid, which has a removal container having an inlet for introducing gas containing the carrier liquid evaporation component and an outlet for ejecting residual gas after the carrier liquid evaporation component is removed, a first gas phase separation filter arranged at the inlet, a second gas phase separation filter arranged at the outlet, and an atomizer which sprays a cyclodextrin solution in the removal container.

DETAILED DESCRIPTION OF THE INVENTION

Figure 1:
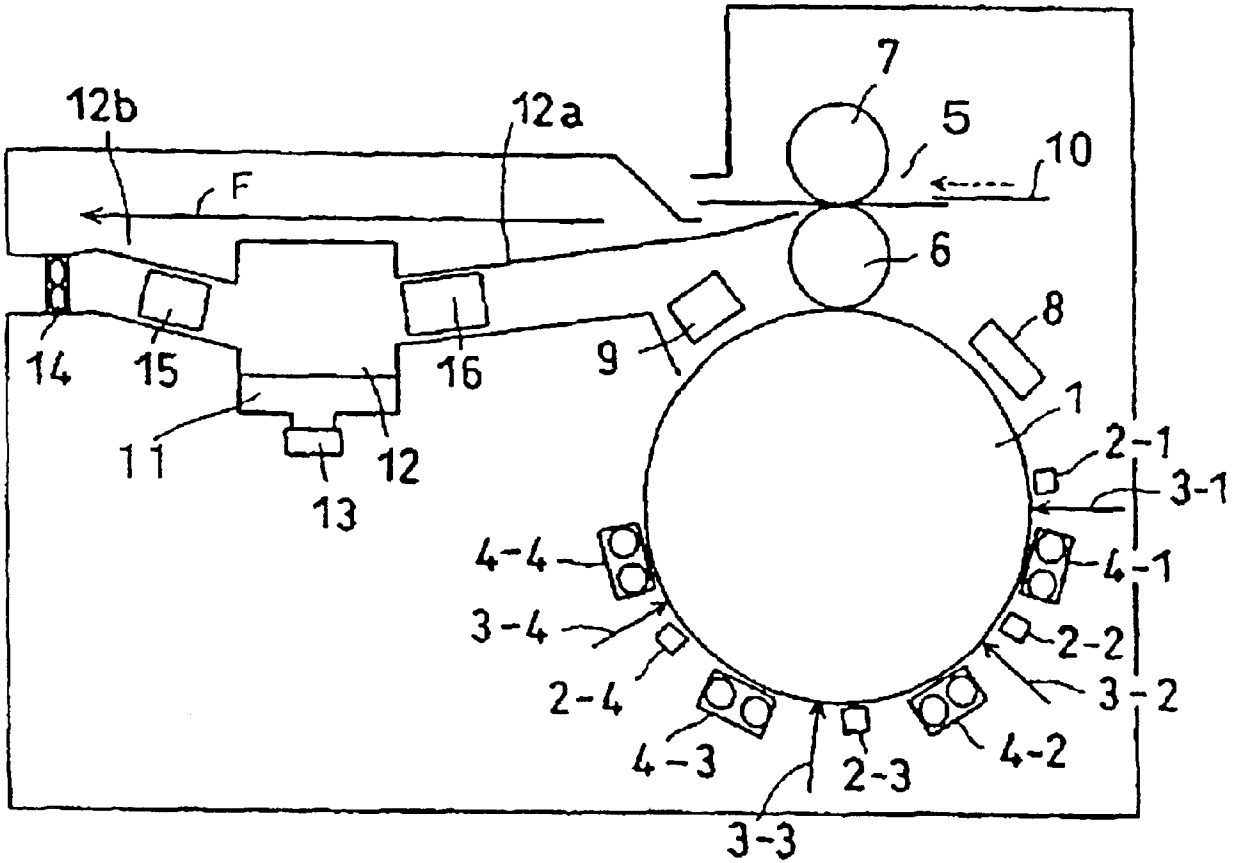
FIG. 1 is a schematic block diagram showing the first embodiment of the electrophotographic apparatus using liquid developer of the present invention and FIG. 2 is a schematic block diagram of an electrophotographic apparatus using liquid developer showing a deformation example of the first embodiment.

FIG. 1 shows the constitution of the electrophotographic apparatus using liquid developer of the first embodiment of the present invention storing the image forming device and carrier liquid removal device in the cabinet of the apparatus.

Firstly, the image forming device in this embodiment of the present invention will be explained.

A latent image holding device 1 is a photosensitive drum having an organic series or amorphous silicon series photosensitive layer on a conductive base. The latent image holding device 1 is uniformly charged by a well-known corona charger or a scorotron charger 2-1 and then receives an exposure 3-1 by an image-modulated laser beam, thus an electrostatic latent image is formed on the surface thereof.

Thereafter, the electrostatic latent image is visualized by a developing unit 4-1 storing a liquid developer. A liquid developer or toner attached to the electrostatic latent image may be sent to the transfer step as it is and transferred onto a recording form by a transfer unit 5. Here, a second electrostatic latent image is continuously formed by a second charger 2-2 and a second laser exposure 3-2 and it is developed by a second developing unit 4-2 storing a second developer having a different color from that of the liquid developer stored in the first developing unit 4-1.

Therefore, after the second development, a toner image of two colors is formed on the latent image holding device 1. In the same way, the third and fourth developments are carried out and a toner image of full colors is formed on the latent image holding device 1. The toner image is transferred onto a recording form by the transfer unit 5. In this case, the toner image may be directly transferred onto a recording form or may be transferred onto a recording form 10 via an intermediate transfer roller 6 as shown in FIG. 6.

With respect to transfer from the latent image holding device 1 to the intermediate transfer roller 6 and transfer from the intermediate transfer roller 6 to the recording form 10, either of transfer by electric field and transfer by pressure (and heat) may be used. Many liquid developers are generally used to fix on a recording form at room temperature, though a pressure roller 7 is heated and fixing by heat may be carried out.

The aforementioned liquid developer has a carrier liquid and toner particles. Toner particles have an average particle diameter of about 1 $\mu$m or less and are charged particles containing a resin component and a coloring agent. The carrier liquid is a dispersing medium of toner particles and an insulating organic liquid is used for it. Generally, a petroleum insulating solvent such as Isopar or Norpar (both are trade names manufactured by Exxon Chemical Ltd. is used.

When a liquid developer is used like this, there are advantages available that a high image quality can be realized because extremely fine toner particles of submicron size can be used, and the liquid developer is economical because sufficient image density can be obtained by a small amount of toner particles and moreover, a texture similar to print, for example, offset print can be realized, and energy conservation can be realized because toner particles can be fixed to a recording form at a comparatively low temperature.

On the other hand, the aforementioned carrier liquid is generally vaporized by nature volatilization in every place where a liquid developer exists in the cabinet of an electrophotographic apparatus and generates vapor.

Furthermore, when the carrier liquid of the liquid developer is intended to be vaporized and removed by heating from on the latent image holding device 1 shown in FIG. 1, or the intermediate transfer roller 6, or the pressure roller 7, or the recording form 10, there is the possibility that a considerable amount of carrier liquid evaporation component may be generated in a cabinet 21 and mixed with air existing in the cabinet and may reach the saturated vapor pressure or concentration close to it. Therefore, for example, to prevent mixed gas containing the carrier liquid evaporation component from ejecting from the cabinet when the cabinet 21 is to be opened due to paper jamming, a carrier liquid removal device for collecting the carrier liquid evaporation component is installed in the cabinet 21.

Next, the carrier liquid removal device will be explained.

A removal container 12 storing a cyclodextrin solution 11 has an inlet 12*a* for introducing mixed gas in the cabinet and an outlet 12*b* for ejecting mixed gas in the removal container 12. The arrow F shown in the drawing indicates the flow of mixed gas. The inlet 12*a* has an opening in a place close to the intermediate transfer roller 6, or the pressure roller 7, or the recording form 10 where the carrier liquid evaporation component concentration is increased, thus the collection efficiency of carrier liquid evaporation component can be increased. Further, the outlet 12*b*, as shown in FIG. 1, may be installed so as to be connected to the outside of the cabinet 21.

Further, in FIG. 1, the carrier liquid removal device is structured so that a suction device such as a fan 14, a blower, or a pump is arranged at the outlet 12*b*, thus mixed gas is sucked in from the inlet 12*a* and ejected from the outlet 12*b*. Further, a plurality of inlets 12*a* and outlets 12*b* may be installed when necessary.

Furthermore, in the inlet 12*a* and the outlet 12*b*, gas phase separation filters 15 and 16 are arranged respectively and the carrier liquid removal device is structured so that gas phases such as the carrier liquid evaporation component and air pass through the gas phase separation filters 15 and 16 and liquids such as a cyclodextrin solution, which will be described later, and water and solids such as an inclusion compound remain in the removal container 12 by the gas phase separation filters 15 and 16.

On the other hand, in the first embodiment, as shown in the drawing, the cyclodextrin solution 11 is stored in the bottom of the removal container 12 as a removal agent for collecting the carrier liquid evaporation component and an ultrasonic transducer 13 which is an atomizer is arranged in the cyclodextrin solution.

Next, cyclodextrin will be explained. Cyclodextrin is cyclic oligosaccharose obtained by acting a certain kind of enzyme to dextrin, which is a compound that glucose –1 and –4 are bound cyclically, and it exists also in the nature. Compounds of 6, 7, and 8 each of glucose bound cyclically are called α-, β-, and γ-cyclodextrin respectively. Furthermore, in the nature, there are many compounds of large cyclic cyclodextrin that glucose is bound cyclically.

Cyclodextrin has a cyclic molecular structure and since there is a cavity in the cyclic structure and the openings are different in size from each other, the molecular structure is a bucket structure. The inside of the cavity is hydrophobic and the cavity takes in an oil substance (guest molecules) and forms an inclusion compound.

When cyclodextrin comes in contact with a hydrophobic material such as a petroleum solvent, it includes the material molecules in the cyclic molecular structure and forms an inclusion compound. Cyclodextrin itself is soluble in water, while the inclusion compound is hardly soluble, so that in a cyclodextrin solution, the inclusion compound becomes white sediment and is separated from the cyclodextrin solution.

When this cyclodextrin solution 11 is sprayed in the removal container 12 by an atomizer such as the ultrasonic transducer 13, the contact area with the carrier liquid evaporation component introduced from the inlet 12*a* is increased. The cyclodextrin solution is reacted when it comes in contact with the carrier liquid and separated into two phases such as an inclusion compound (solid) and water and the inclusion compound drops and precipitates in the cyclodextrin solution stored in the bottom of the removal container 12 by its own weight or is collected by the gas phase separation filter 15. On the other hand, the residual gas (generally air) obtained by removing the carrier liquid evaporation component from the mixed gas passes through the gas phase separation filter and is ejected from the cabinet 21.

In this way, the carrier liquid evaporation component can be removed from the mixed gas.

Next, in this embodiment of the present invention, a case of continuous removal of the carrier liquid evaporation component will be explained.

An unreacted cyclodextrin solution sprayed and a part of reacted and produced inclusion compound (and water) are collected by the gas phase separation filter 15 arranged at the outlet 12*b* by the flow of mixed gas from the inlet 12*a* to the outlet 12*b* and flow and drop by the own weight.

For example, the outlet 12*b* is inclined toward the removal container 12 and the collected cyclodextrin solution, inclusion compound, and water are returned to the removal container 12. As a result, when the cyclodextrin solution is continuously sprayed by the ultrasonic transducer 13, in the bottom of the removal container 12, the cyclodextrin solution 11 whose concentration is lowered compared with that in the initial state and the inclusion compound precipitated in the solution are stored.

When the ultrasonic transducer 13 is driven in this state, only the cyclodextrin solution which is a liquid is sprayed again and used to collect the carrier liquid evaporation component.

Therefore, when the carrier liquid evaporation component is removed continuously, in the same way as with activated carbon, the carrier liquid evaporation component removal function of the cyclodextrin solution is lowered and at the point of time when a predetermined amount of carrier liquid evaporation component is collected, the cyclodextrin solution must be exchanged.

When the carrier liquid evaporation component is collected by activated carbon as conventional, no visual changes are seen before and after removal of the carrier liquid evaporation component. However, when the carrier liquid evaporation component is collected by a cyclodextrin solution, since the inclusion compound is white as mentioned above, the cyclodextrin solution 11 becomes milky. The degree of function reduction of the carrier liquid evaporation component can be judged by the milky degree and when the solution reaches predetermined whiteness, the cyclodextrin solution may be interchanged with a new one.

As shown in FIG. 1, when the cyclodextrin solution 11 is to be sprayed by the ultrasonic transducer 13, it is preferable to set the distance between the main surface (the surface for oscillating ultrasonic waves) of the ultrasonic transducer 13 and the surface of the cyclodextrin solution to about 10 mm to 30 mm. When the distance is not within the range, there is the possibility that the cyclodextrin solution may not be sprayed though slightly different depending on the frequency and intensity of ultrasonic waves oscillated from the ultrasonic transducer 13 and the viscosity (concentration) of the cyclodextrin solution.

When the ultrasonic transducer 13 is used for spraying, it is preferable to set the concentration of the cyclodextrin solution 11 to about 5 to 20 wt %. When the concentration of the cyclodextrin solution is more than 20 wt %, the viscosity is increased, and the cyclodextrin solution may not be sprayed, while the concentration is less than 5 wt %, the carrier liquid evaporation component cannot be collected sufficiently.

Further, to the cyclodextrin solution, another additive such as an antiseptic agent can be added, and the viscosity can be reduced by raising the temperature of the cyclodextrin solution, and generation of bacteria can be prevented at the same time.

Figure 2:
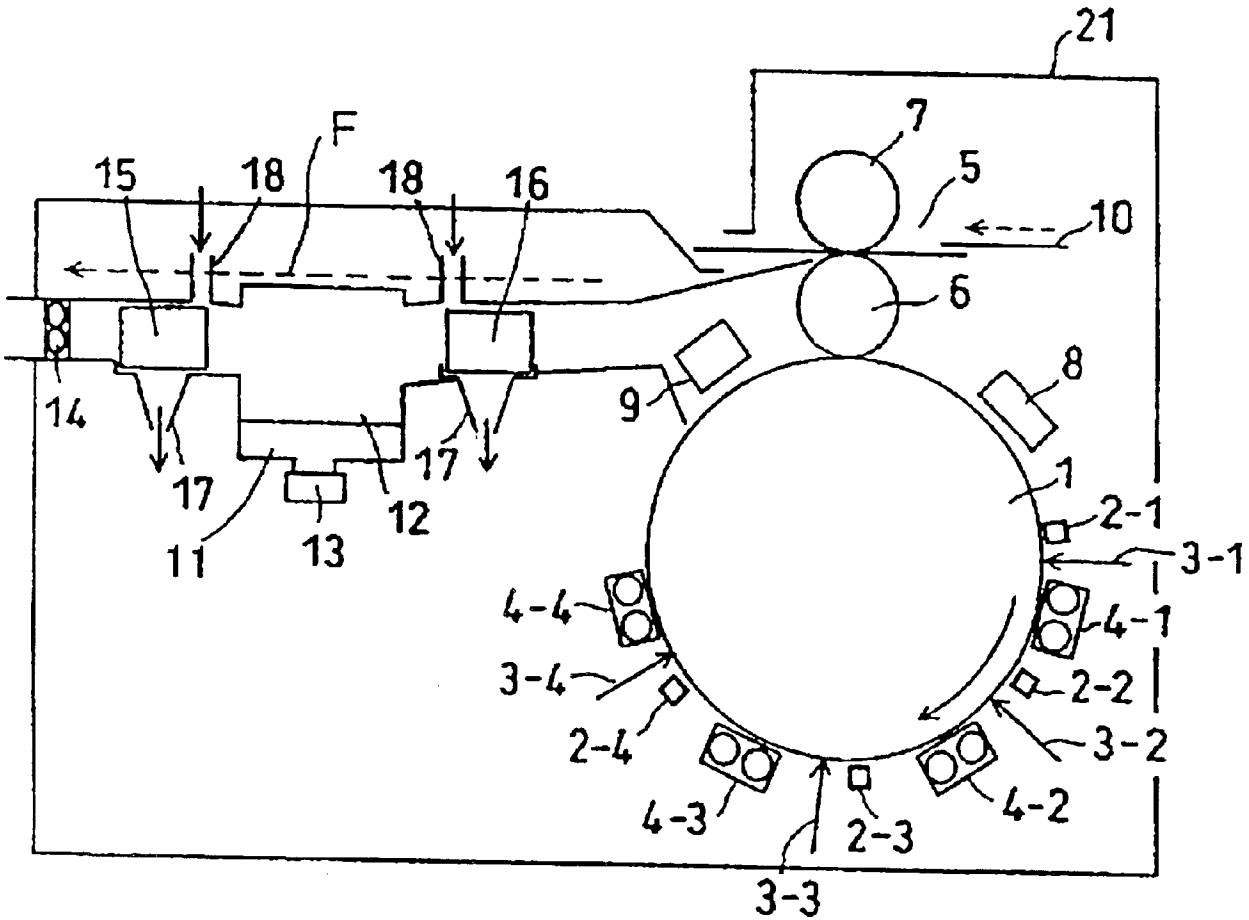

FIG. 2 is a schematic block diagram of an electrophotographic apparatus showing a deformation example of the first embodiment of the present invention.

The electrophotographic apparatus using liquid developer shown in FIG. 2 is different from the electrophotographic apparatus shown in FIG. 1 in that a water feed port 18 for feeding water to the gas phase separation filter 15 or 16 and an ejection port 17 for ejecting the fed water are formed.

When the gas phase separation filters 15 and 16 are used over a long period of time, an inclusion compound is partially adhered and the filters may be clogged. However, when water is fed from the water feed port 18, the adhered inclusion compound is ejected from the ejection port 17 by the water flow and the gas phase separation filters 15 and 16 can be washed. The washing may be executed at the time of exchange of the cyclodextrin solution.

Figure 3:
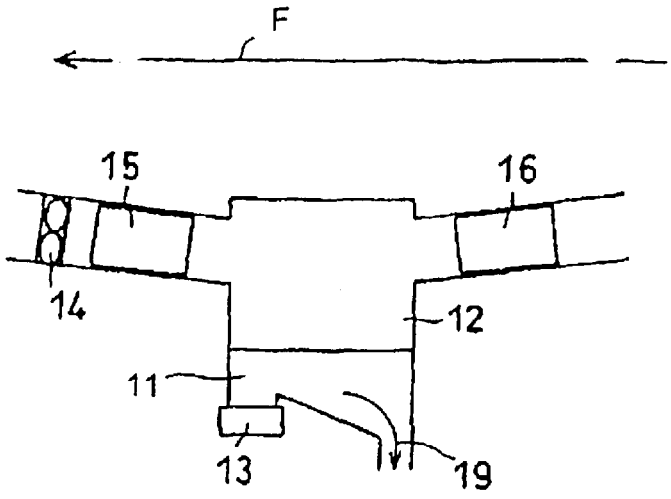
FIG. 3 is a cross sectional view showing the constitution of the carrier liquid removal device of the second embodiment of the present invention and FIG. 4 is a drawing for explaining the circulation condition of a cyclodextrin solution in the carrier liquid removal device of another embodiment of the present invention.

FIG. 3 is a drawing showing the second deformation example of the first embodiment of the present invention, which is an enlarged view of the removal container 12. In FIG. 3, concavities are formed at both ends of the bottom of the removal container 12 and between the concavities, an inclination, for example, a lower right inclination is formed as shown in the drawing. The ultrasonic transducer 13 is arranged in the concavity formed on the high inclined side, for example, on the left side in the drawing.

When the bottom of the removal container 12 is structured so as to form an inclination between the concavities like this, the inclusion compound is deposited in the concavity arranged on the lower side of the inclination. Namely, when the inclusion compound in the cyclodextrin solution stirred and dispersed by the ultrasonic transducer 13 is precipitated, it is collected in the concavity arranged on the lower side of the inclination along the inclination as shown by the arrow 19. Since the sound pressure of ultrasonic waves oscillated from the ultrasonic transducer 13 is low at the lower end of the inclination, the inclusion compound precipitated at the lower part of the inclination once is kept in the precipitation state even if the ultrasonic transducer is driven.

As mentioned above, when the viscosity of the cyclodextrin solution is increased, spraying by the ultrasonic transducer is difficult. However, by use of this constitution, rise of the viscosity of the cyclodextrin solution due to the inclusion compound is suppressed and the cyclodextrin solution can be sprayed stably.

Further, even in the embodiment of the present invention shown in FIG. 3, to wash the respective gas phase separation filters 15 and 16, the water feed ports 18 for feeding water to the filters and the ejection ports 17 for ejecting water fed from the water feed ports can be provided.

Figure 4:
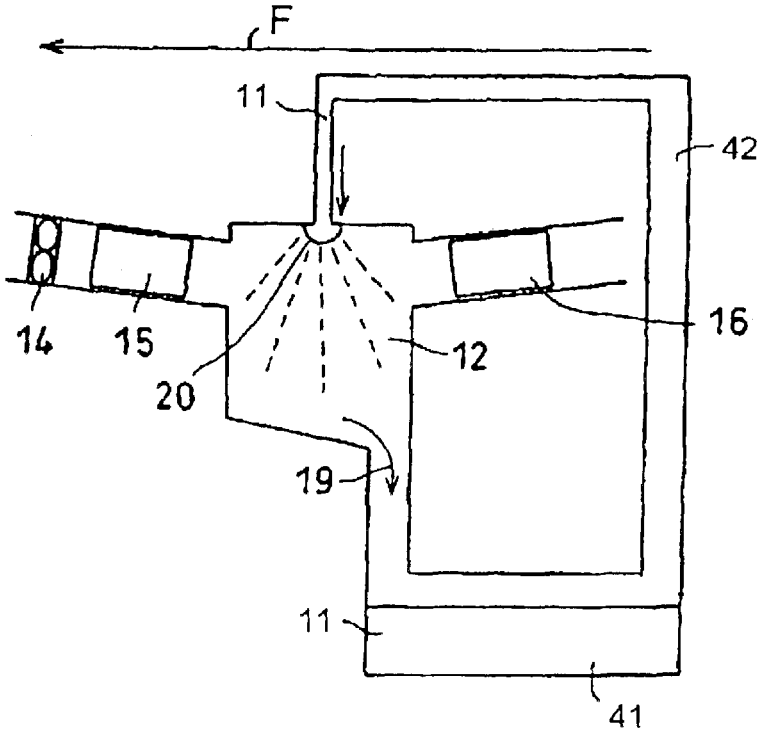

FIG. 4 is a drawing showing a cyclodextrin removal device to be used in the second embodiment of the present invention. Further, this cyclodextrin solution removal device is also housed in the cabinet of the electrophotographic apparatus together with the image forming device shown in FIG. 1.

The carrier liquid evaporation component removal device shown in FIG. 4 uses an injection type spray 20 as an atomizer. When the injection type spray is used, for the viscosity of a solution in which cyclodextrin is saturated and dissolved, the solution can be sprayed, so that a high-concentration cyclodextrin solution can be sprayed into the carrier liquid evaporation component removal container 12.

Further, the cyclodextrin solution 11 is structured so as to circulate a storage tank 41, the spray 20, the removal container 12, and the storage tank 41 sequentially.

The cyclodextrin solution 11 stored in the storage tank 41 is pumped up by a pump 42 and fed to the spray 20. Next, the cyclodextrin solution fed to the spray 20 is fed to the removal container 12 in an atomized state, collects the carrier liquid evaporation component introduced from the inlet 12*a*, and generates an inclusion compound. Furthermore, the unreacted cyclodextrin solution, inclusion compound, and water, in the same way as with those explained in the first embodiment, move downward in the removal container 12 by the own weights and are returned to the storage tank 41 along the inclination formed in the bottom of the removal container 12.

The storage tank 41 functions also as a precipitation tank and in the storage tank 41, the inclusion compound is precipitated and separated in the cyclodextrin solution, so that the cyclodextrin solution can be fed from the pump 42 to the spray 20 without containing the inclusion compound, thus the spray is prevented from clogging. Further, unless the storage tank 41 functions as a precipitation tank, a filter using a filter paper in the circulation system may be arranged. Further, the storage tank 41 functions as a precipitation tank and moreover the filter may be added.

On the basis of the whiteness of the solution made milky by the inclusion compound in the storage tank 41 in this way, the degree of collection of the carrier liquid evaporation component can be ascertained visually and the removal capacity of the carrier liquid evaporation component in the cyclodextrin solution can be ascertained as well.

The cyclodextrin solution 11 stored in the storage tank 41 that the cyclodextrin content is increased up to the saturation concentration can be used as mentioned above. However, cyclodextrin is added additionally to the storage tank 41 and cyclodextrin exceeding the saturation amount may be contained in the storage tank 41. Namely, when the storage tank functions as a precipitation tank or a filter is arranged, cyclodextrin exceeding the saturation amount is precipitated or filtered in the storage tank 41. By doing this, only the cyclodextrin solution is fed to the spray 20, so that the cyclodextrin solution can be atomized without clogging the spray.

As mentioned above, when the carrier liquid evaporation component is removed continuously, the concentration of the cyclodextrin solution is lowered. However, when cyclodextrin more than the saturation amount is contained in the storage tank 41, the concentration of the cyclodextrin solution to be sprayed can be maintained over a long period of time and the exchange frequency of the cyclodextrin solution can be reduced as well.

Further, also in the embodiment of the present invention shown in FIG. 4, to wash the respective gas phase separation filters 15 and 16, the water feed ports 18 for feeding water to the filters and the ejection ports 17 for ejecting water fed from the water feed ports can be provided.

As explained above, according to the present invention, in the electrophotographic apparatus using liquid developer having a carrier liquid removal device, the time of exchange of a carrier liquid removal agent can be judged visually.

What is claimed is:

1. A method of removing a carrier liquid evaporation component from a cabinet housing an electrophotographic apparatus that develops an electrostatic latent image with a liquid developer having toner particles dispersed in the carrier liquid, the method comprising the steps of:

providing a carrier liquid evaporation component removal container inside the cabinet;

introducing mixed gas containing the carrier liquid evaporation component from inside the cabinet into the carrier liquid evaporation component removal container;

spraying a cyclodextrin solution into the carrier liquid evaporation component removal container after the introducing step, wherein the cyclodextrin solution sprayed into the carrier liquid evaporation component removal chamber reacts with the mixed gas to remove the carrier liquid evaporation component from the mixed gas; and ejecting residual gas remaining after the carrier liquid evaporation component is removed from the mixed gas from the carrier liquid evaporation component removal chamber.

2. The method recited in claim 1, further comprising the steps of:

providing the carrier liquid evaporation component removal chamber with an inlet having an associated gas phase separation filter for introducing the mixed gas; and providing the carrier liquid evaporation component removal chamber with an outlet having an associated gas phase separation filter for ejecting the residual gas.

3. The method recited in claim 1, further comprising the steps of:

separating any unreacted cyclodextrin solution in the carrier liquid evaporation component removal chamber; and providing the unreacted cyclodextrin solution separated in the separating step to be resprayed by an atomizer performing the spraying step.

4. The method recited in claim 1, further comprising the steps of:

providing a cyclodextrin solution storage unit;

supplying the cyclodextrin solution from the cyclodextrin solution storage unit to the atomizer for performing the spraying step.

5. The method recited in claim 4, further comprising the step of:

providing the atomizer with an ultrasonic transducer for spraying.

6. The method recited in claim 4, further comprising the step of:

providing the carrier liquid evaporation component removal chamber with an inclined bottom portion having the cyclodextrin solution storage unit at a high part of the inclined bottom portion; and providing the atomizer at a lower part of the inclined bottom portion than the high part of the inclined bottom portion.

* * * * *